US007096951B2

(12) United States Patent
Cox

(10) Patent No.: US 7,096,951 B2
(45) Date of Patent: Aug. 29, 2006

(54) METHOD AND APPARATUS FOR RETRIEVING AN OBJECT FROM A WELL BORE

(76) Inventor: Jay D. Cox, P.O. Box 623, Perryton, TX (US) 79070

( * ) Notice: Subject to any disclaimer, the term of this patent is extended or adjusted under 35 U.S.C. 154(b) by 170 days.

(21) Appl. No.: 10/799,132

(22) Filed: Mar. 12, 2004

(65) Prior Publication Data

US 2005/0199398 A1 Sep. 15, 2005

(51) Int. Cl.
*E21B 31/00* (2006.01)

(52) U.S. Cl. ..... 166/301; 166/98; 294/86.24

(58) Field of Classification Search ..... 166/98, 166/99, 301; 294/86.24, 86.25
See application file for complete search history.

(56) References Cited

U.S. PATENT DOCUMENTS

| | | | | |
|---|---|---|---|---|
| 430,919 | A | 6/1890 | Campbell et al. | |
| 1,497,541 | A | 6/1924 | Camblin | |
| 2,211,973 | A * | 8/1940 | Gauthier | 285/390 |
| 2,243,419 | A * | 5/1941 | Festervan et al. | 294/86.18 |
| 2,633,808 | A | 4/1953 | Webber | |
| 3,990,509 | A | 11/1976 | Hedgecock et al. | |
| 4,184,504 | A | 1/1980 | Carmichael et al. | |
| 4,312,406 | A | 1/1982 | McLaurin et al. | |
| 4,862,957 | A | 9/1989 | Scranton | |
| 5,242,201 | A | 9/1993 | Beeman | |
| 5,549,474 | A | 8/1996 | Cohen | |
| 5,618,169 | A | 4/1997 | Smith | |
| 5,639,135 | A | 6/1997 | Beeman | |
| 5,947,202 | A * | 9/1999 | Gazewood | 166/301 |
| 6,186,237 | B1 | 2/2001 | Voss, Jr. et al. | |

* cited by examiner

*Primary Examiner*—William P. Neuder
(74) *Attorney, Agent, or Firm*—McAfee & Taft

(57) ABSTRACT

A fishing tool apparatus for retrieving an object from within a well bore, wherein the object has an opening for receiving the apparatus, comprises a support rod, an expandable sleeve, and a biasing means. The expandable sleeve may be externally threaded for engaging the object, is slidably mounted on the support rod, and is movable from a narrow diameter insertion position to an expanded engaging position. Once inserted, the biasing means biases the expandable sleeve to the expanded engaging position, thus facilitating engagement. Thus the expandable sleeve is inserted and engaged without applying torque thereto.

27 Claims, 3 Drawing Sheets

METHOD AND APPARATUS FOR RETRIEVING AN OBJECT FROM A WELL BORE

BACKGROUND OF THE INVENTION

The present invention relates to an improved apparatus and improved method for retrieving objects from a well bore.

Diesel, solar and wind powered water wells are often used where it is difficult or expensive to provide electrical power. While solar power and windmills can be operated to generate electricity for an electric pump, the most common type of pump used with such water wells is a positive displacement cylinder pump. A positive displacement cylinder pump is driven by a reciprocating rod connected, for example, to a gear box at the windmill rotor.

Generally, any mechanism that seals water in a chamber and then forces it out by reducing the volume of the chamber can be considered a positive displacement pump. Piston, or plunger pumps are reciprocating pumps that use a piston or plunger to move the water through a cylindrical chamber. When such pumps are used in a well bore, the cylinder and piston are positioned below the water table in the well bore, and water must flow into the well bore from below the cylinder. When the piston moves up, a bottom, or lower check valve allows water to flow into the cylinder. When the piston moves down, the bottom check valve closes and water is forced through an upper, or top check valve to the surface.

Many repairs required in wells that use positive displacement pumps are due to debris in the cylinder or "working barrel" of the pump. The debris can be foreign material entering the well from the surface or silt and sand entering from the subterranean formation. The debris can also be worn rings, seals, sleeves, or other material from the pump itself. Whatever the source, the debris can jam the plunger in the cylinder and can also plug the opening of one of the check valves, which makes it impossible to close or open the valve and operate the pump efficiently. The plugging debris must be removed to restore operability to the pump.

Raising the plunger and upper check valve does not generally present a problem since both are already connected to the surface by the plunger rod. The plunger and upper check valve can be repaired or replaced on the surface and positioned back in the well. However, removal of the plugging debris requires pulling the pipe string, and this is a major cost.

Because the lower check valve is not connected to the plunger rod, it will generally remain in place. Check valves used in displacement pumps have an internally and externally threaded neck at the top thereof (the part facing up when placed in the well bore). The most commonly used check valves are ball type and spool type check valves. When the bottom check valve becomes plugged, it will either not close properly or not open properly. If the check valve cannot close completely, the plunger will displace water back to the formation rather than to the surface. If the check valve cannot open completely, water will not enter the well at the desired rate from the reservoir. Thus, when the bottom check valve is plugged, it must in many cases be removed. Because of the difficulty and high cost to remove the bottom check valve, such wells are often abandoned.

In some circumstances, the bottom check valve can be removed using a threaded tool at the end of a rod to threadedly engage the threaded valve neck. To remove the bottom check valve, the threaded tool must be rotated into the bottom check valve. In many wells this is very risky, in that the torsion required to thread the tool into the bottom check valve can cause the rod to break. Retrieval of the bottom check valve is made more difficult if any silt or other material is on the surface of the inner threads of the valve neck. Additionally, if the bottom check valve is not properly aligned vertically within the well, it is very difficult, and may be impossible, to thread the threaded tool into the check valve.

There is a need for a tool which will enable efficient removal of the lower, or bottom check valve from a water well, thus reducing repair costs and extending the life of the well.

SUMMARY OF THE INVENTION

The present invention meets the aforementioned need by providing apparatus and methods for retrieving objects from within a well bore. A fishing tool of the present invention for retrieving an object from within a well bore comprises a support rod and an expandable sleeve. The expandable sleeve is slidably disposed about the support rod and is movable from an insertion position to an expanded engaging position. The expandable sleeve may have a plurality of external ridges thereon for grippingly engaging the object to be removed. The expandable sleeve may be externally threaded to engage an internal thread defined in an opening of the object to be removed. The support rod has an insertion tip and has an external diameter of varying size. The expandable sleeve is displaceable by the object to the insertion position, thus facilitating insertion without applying torque thereto. The weight of the sleeve, or a biasing means, which may be a spring disposed about the support rod, urges the expandable sleeve to the expanded engaging position, thus facilitating engagement.

The expandable sleeve comprises two or more longitudinal slits extending along the entire length thereof to define a plurality of completely separable expandable sleeve sections. One or more O-rings circumscribe the expandable sleeve to apply an inwardly directed radial force to the expandable sleeve and the O-rings cause the expandable sleeve to contract around the support rod.

The methods of the present invention comprise using the fishing tool to retrieve the object from within the well bore. The fishing tool is lowered into the well bore to the object. Using the object and a downward force on the tool, the expandable sleeve is displaced toward the insertion position on the support rod while the insertion tip is inserted into the object opening. At least a portion of the expandable sleeve is inserted into the object opening while the expandable sleeve is in the insertion position. The object is engaged by applying an upward force to raise the support rod while the biasing means biases the expandable sleeve toward the expanded engaging position. Once the fishing tool has engaged the object, the tool and object may be raised from the well bore.

The objects, features and advantages of the present invention will be readily apparent to those skilled in the art upon a reading of the description of preferred embodiments which follows.

DESCRIPTION OF PREFERRED EMBODIMENTS

The present invention provides apparatus and methods for retrieving an object from within a well bore without the application of torque. The invention embodies the use of a fishing tool connected to a rod or cable and lowered to the object in a well. The tool is particularly useful for removal of the lower check valve used in a positive displacement type pump in deep water wells.

A lower check valve used in water wells typically has an upper neck which is threaded both internally and externally. Such a check valve is used herein to describe the working of the inventive tool. However, it is understood that the apparatus and methods of this invention can be applied to retrieval of any object having an opening for receiving the apparatus from any type of well including, but not limited to, water, oil, gas and injection wells.

The tool comprises a variable diameter support rod and an expandable sleeve. The support rod has a first, or lower end and a second, or upper end. The expandable sleeve has a plurality of circumferential external ridges thereon, which may be defined by an external thread. The ridges on the expandable sleeve will engage the object opening, which may be an internally threaded object opening of the object to be retrieved from a well. The expandable sleeve can be inserted into the object opening simply by "spearing" the object. Preferably the tool is lowered using a cable and the expandable sleeve is inserted into the object opening (speared) using gravity, or more preferably, a jar. A jar is a tool commonly used in the well servicing industry to apply a sudden force on an object within a well.

The expandable sleeve is slidably disposed about the support rod and is movable between an insertion position and an expanded engaging position. The expandable sleeve is displaceable to the insertion position using the object and a downward force. Once the expandable sleeve is inside the object opening, the expandable sleeve moves to the expanded engaging position. When the sleeve expands, the ridges on the sleeve firmly engage the object to be retrieved. It is not necessary to attempt to actually thread the sleeve into the object by attaining accurate vertical alignment and applying torque to the tool from the surface as would be required using conventional methods.

The expandable sleeve is slidably mounted on the support rod, and has one or more longitudinal slits extending along at least a portion of the length of sleeve. The slits permit the sleeve to expand and contract radially. The application of an inward radial force created, for example, by an O-ring mounted circumferentially on the expandable sleeve, causes the sleeve to contract radially around the external surface of the support rod.

Figure 2:
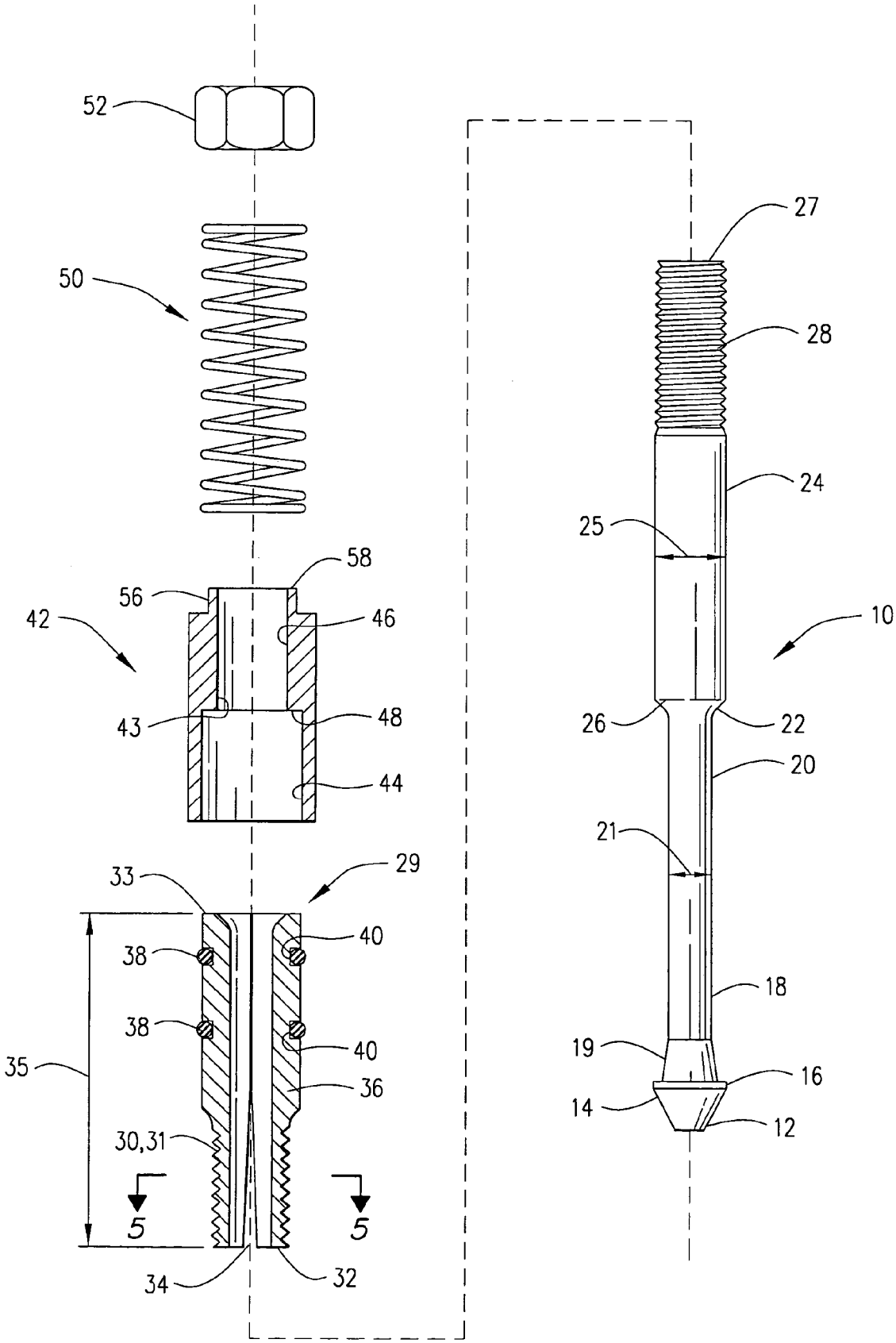
FIG. 2 is an exploded view of components of the tool.
Figure 3:
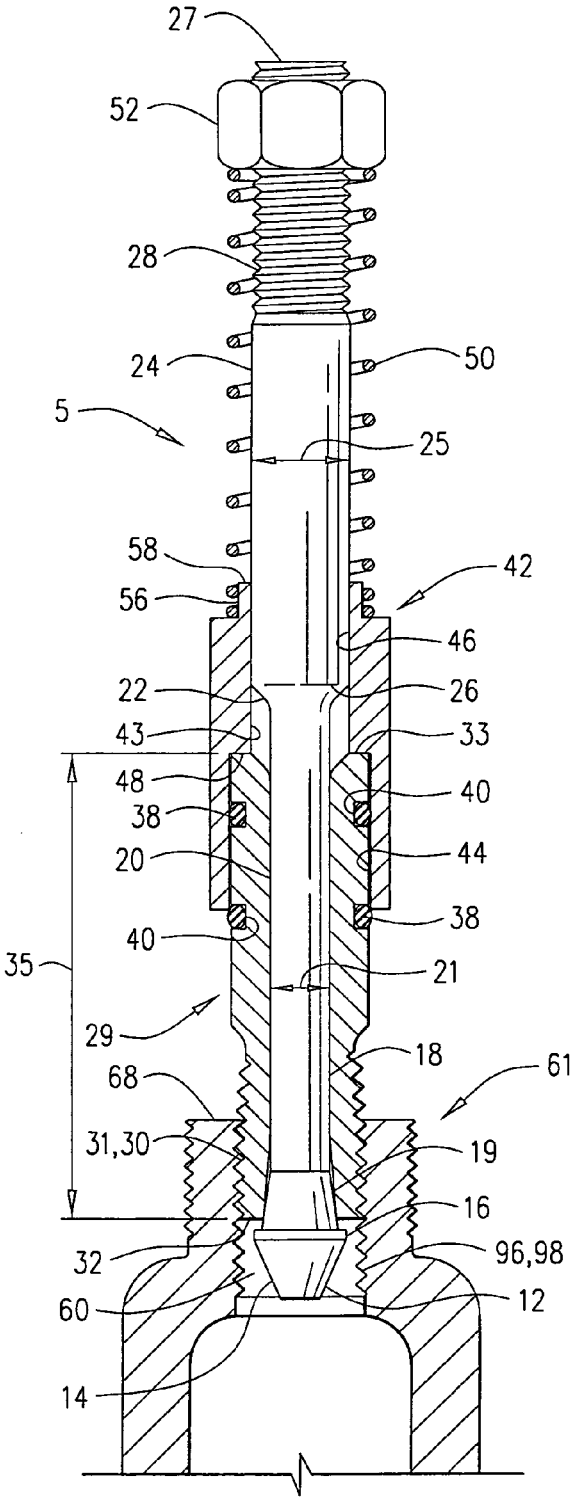
FIG. 3 shows the tool in the expanded engaging position.
Figure 4:
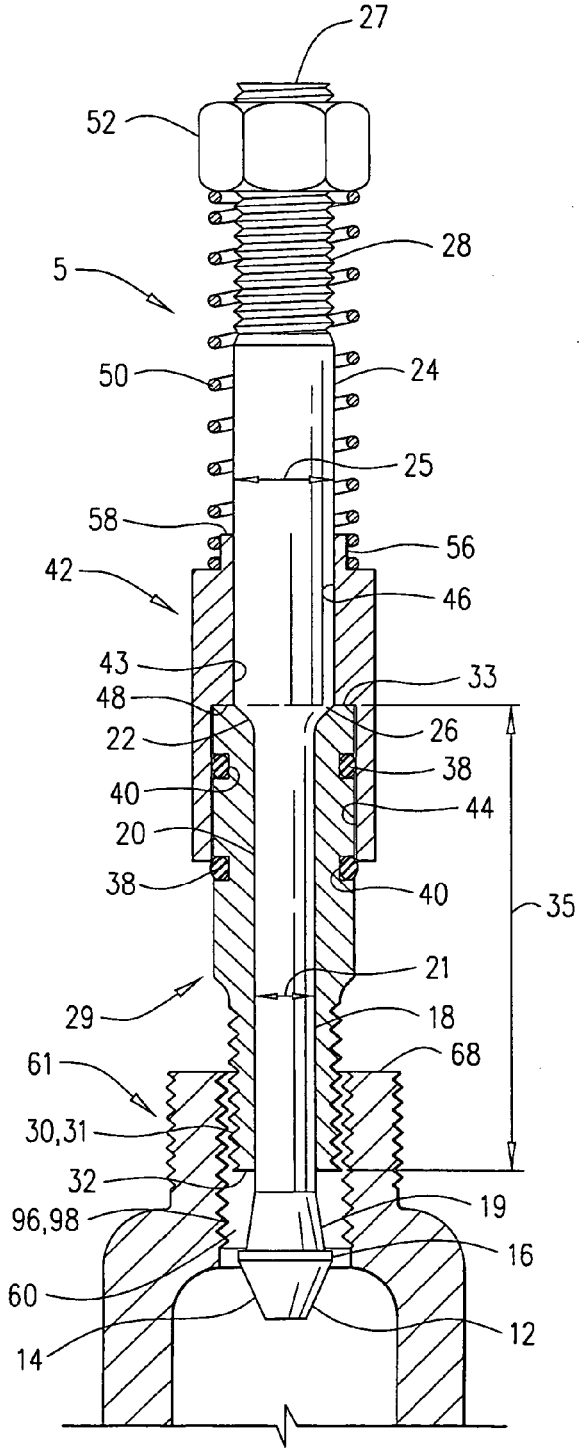
FIG. 4 shows the tool in the insertion position.

Referring now to the drawings, and more particularly to FIGS. 3 and 4, the tool, or apparatus 5 is shown in the expanded engaging and the insertion positions, respectively. Apparatus 5 comprises a support rod 10, which, as shown more clearly in FIG. 2, comprises a tapered insertion tip 12 with a taper 14. A lip 16 defines the largest diameter on insertion tip 12. Lip 16 is sized to fit within the object opening of the object to be retrieved from a well. In the embodiment described, such object is the lower check valve in a water well.

A neck, or stem 18 of support rod 10 has a tapered portion 19 and a narrow portion 20. Tapered portion 19 tapers radially inwardly from its largest diameter adjacent lip 16 to a diameter 21 of narrow portion 20, which is preferably a constant diameter 21. Neck 18 terminates at an upper end 22 thereof, where it is connected to support rod body 24. Support rod body 24 has outer diameter 25, which is greater than diameter 21. Support rod body 24 has first, or lower end 26, and second, or upper end 27. Support rod body 24 has threads 28 thereon for connection to a pipe, tubing, other string or coupling to a cable used to lower apparatus 5 into a well.

Referring to FIGS. 2, 3 and 4, expandable sleeve 29 has a plurality of ridges 31 thereon, which may be defined by an external thread 30. Expandable sleeve 29 has first, or lower end 32 and second, or upper end 33. Threads 30 extend upwardly from lower end 32. Sleeve 29 is mounted on, and is preferably slidably disposed about support rod 10. Expandable sleeve 29 is slidably disposed about neck 18 between lip 16 and support rod body 24, and is movable thereon between an insertion position and an expanded, or gripping position. In the insertion position, the expandable sleeve is disposed about narrow section 20, and in the expanded position, the expandable sleeve 29 is disposed at least partially about tapered portion 19. As will be explained in more detail hereinbelow, an outer diameter of the sleeve in the expanded position will grippingly engage the object opening of the object to be retrieved.

Figure 5:
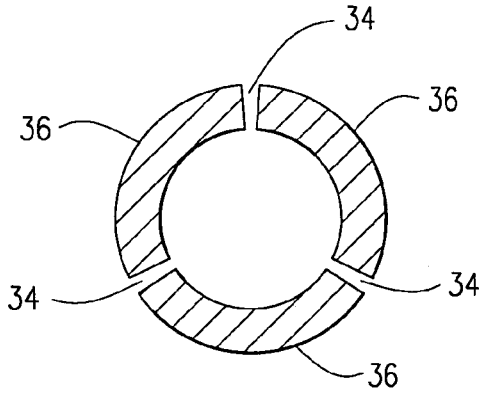
FIG. 5 is a cross-section from line 5—5 of FIG. 2.

Expandable sleeve 29 comprises one or more longitudinal slits 34 extending along at least a portion of the sleeve length 35. Preferably expandable sleeve 29 is formed with three longitudinal slits 34 extending along the entire length 35 of expandable sleeve 29. Slits 34 are preferably equally spaced around the sleeve circumference. Thus, expandable sleeve 29 is preferably comprised of a plurality of, and in the embodiment shown three sleeve sections 36 that are completely separable as shown in FIG. 5.

Expandable sleeve 29 may have one or more resilient rings, such as O-rings 38 disposed in grooves 40. O-rings 38 will contract expandable sleeve 29 about support rod 10 and specifically about neck 18. The combination of resilient rings and completely separable sleeve sections aids engagement when the tool 5 and object to be retrieved are misaligned. The arrangement allows sufficient movement of the sleeve sections such that expandable sleeve 29 may be inserted in object opening 60 when the apparatus 5 and the object opening 60 are not perfectly axially aligned.

A jacket 42 may be mounted over the expandable sleeve 29 at the upper end 33 thereof and partly over the support rod body 24. Jacket 42 has inner surface 43 defining first and second inner diameters 44 and 46. Inner diameter 44 is disposed about expandable sleeve 29, and diameter 46 is disposed about support rod body 24. A shoulder 48 is defined by and extends between diameters 44 and 46, and abuts second end 33 of expandable sleeve 29.

A biasing means 50, which is preferably a spring 50 may be mounted on support rod body 24. Spring 50 is positioned between expandable sleeve 29 and a stop 52 on support rod body 24. Stop 52 may comprise a nut threaded on threads 28, which may also be threaded onto a rod, pipe, cable connector or other device for lowering apparatus 5 into a well. Spring 50 provides a downward bias on expandable sleeve 29 by pushing against jacket 42, which urges expandable sleeve 29 downwardly. Jacket 42 may have a stem 56 on the upper end 58 thereof, about which spring 50 is disposed.

Figure 1:
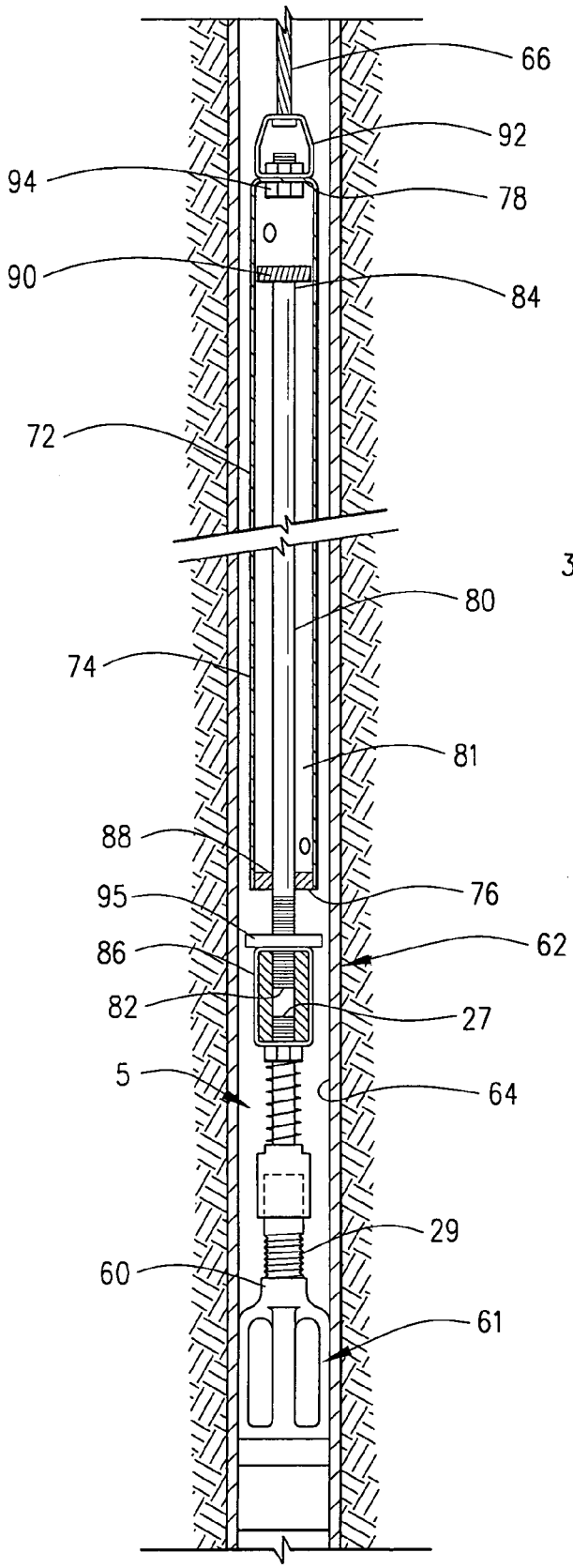
FIG. 1 is a schematic view of the tool of the current invention lowered in a well.

Referring now to FIG. 4, tapered insertion tip 12 fits within an internally threaded object opening 60 of an object 61 to be retrieved. Preferably, object 61 is a lower check valve 61 disposed in a water well, such as well 62, schematically shown in FIG. 1. Well 62 defines a wall 64. Tool 5 may be lowered into well 62, which may be a water well, on a cable 66, or with tubing, pipe or other means known in the art. When tool 5 is lowered into well 62, expandable sleeve 29 is in an expanded position, and has a diameter larger than a diameter of object opening 60. Thus, when tool 5 initially engages object 61, lower end 32 of expandable sleeve 29 will engage an upper end 68 of object 61. Continued or sudden downward pressure on tool 5 will cause insertion tip 12 to be inserted into object opening 60 and expandable sleeve 29 will slide upwardly relative to support rod 10. The diameter of the support rod decreases from lip 16 to narrow portion 20. Expandable sleeve 29 will contract radially around the neck 18 of the support rod and will move to the insertion position, around narrow portion 20, in which it may be inserted into object opening 60 as shown in FIG. 4.

Preferably, a jar 72 is used to provide the downward force or a heavy blow which will cause or assist fishing tool 5 to be inserted into the object opening. A jar is a tool commonly used and well known by those skilled in the art of well servicing. There are many types and designs of jars. The jar 72 shown in FIG. 1 comprises a jar pipe 74 having a first end 76 and a second end 78 slidably disposed about a jar rod 80 such that a space 81 remains between the exterior of jar rod 80 and the interior of jar pipe 74. Jar rod 80 has a threaded first end 82 and has a second end 84. The jar rod first end 82 is connected to second end 27 of support rod body 24 by means of, for example, a threaded coupling 86. Jar pipe first end 76 has an opening 88 slightly larger in diameter than the diameter of jar rod 80. A slide 90 is disposed in jar pipe 74 and attached to jar rod second end 84. Slide 90 has an outer diameter greater than jar pipe opening 88 such that slide 90 provides guidance and also a stop to keep the jar rod 80 and attached fishing tool 5 from becoming separated from jar pipe 74. Jar pipe second end 78 is connected to a wire rope socket 92 by means of, for example, socket bolt 94. Wire rope socket 92 may have varied designs to provide a secure connection between jar pipe 74 and cable 66 used to lower the tool 5 and jar 72 into the well.

The tool 5 is placed above the object 61 preferably with the aid of a guide 95. Guide 95 is positioned to properly center tool 5, but provides for limited movement so that apparatus 5 may be inserted in object opening 60 even in cases where object 60 is not centered in the well. The weight of the jar pipe provides the downward force helpful in inserting the expandable sleeve 29 into object opening 60. In the schematic in FIG. 1, the tool 5 has been lowered onto the object 61 and jar pipe 74 has been dropped. As shown schematically, jar pipe first end 76 has not yet contacted jar rod guide 95. When contact occurs, jar pipe 74 provides a heavy force to jar rod 80 which will cause or assist expandable sleeve 29 to be inserted in object opening 60.

Once expandable sleeve 29 is in object opening 60, downward pressure is released. Upward pressure is applied and the support rod 10 is pulled upward. Gravity, friction between the expandable sleeve thread 30 and the inner surface 96 of object opening 60, and the spring 50 cause the expandable sleeve 29 to remain in place with respect to the object opening 60 so that support rod 10 moves upward relative thereto. Expandable sleeve 29 expands as it moves on tapered portion 19 until the thread 30 grippingly engages inner surface 96, and preferably internal threads 98 of object opening 60. Tool 5 may then be raised, which may cause additional expansion of expandable sleeve 29 on support rod 10. Threads 30 on expandable sleeve 29 will grippingly engage threads 98, so that object 61 can be withdrawn from the well.

Thus, the present invention is well adapted to carry out the objects and attain the benefits and advantages mentioned as well as those that are inherent therein. While numerous changes to the apparatus and methods can be made by those skilled in the art, such changes are encompassed within the spirit of this invention as defined by the appended claims.

What is claimed is:

1. An apparatus for retrieving an object from within a well, wherein the object has an object opening for receiving the apparatus, the apparatus comprising:

a support rod having a first end and a second end; and an expandable sleeve having a plurality of external ridges thereon slidably disposed about the support rod, the expandable sleeve being movable from an insertion position wherein the expandable sleeve may be inserted into the object opening to an engaging position wherein the external ridges grippingly engage the object; and a biasing means for biasing the expandable sleeve to the engaging position.

2. The apparatus of claim 1 wherein the plurality of external ridges is defined by a thread and wherein the object opening has an internal thread.

3. The apparatus of claim 1 wherein the support rod comprises a variable outer diameter.

4. The apparatus of claim 1 wherein the expandable sleeve contracts around the support rod.

5. The apparatus of claim 1, the support rod comprising a tapered insertion tip at the first end of the support rod, wherein the insertion tip tapers radially inwardly from its greatest diameter, the greatest diameter of the insertion tip being slightly less than the diameter of the object opening so that the tapered insertion tip is insertable into the object opening.

6. The apparatus of claim 5, the support rod comprising a stem extending from the insertion tip, the stem comprising a tapered portion adjacent the insertion tip, wherein the tapered portion tapers radially inwardly from adjacent the insertion tip.

7. The apparatus of claim 6 wherein in the insertion position the expandable sleeve is disposed about a narrow section of the stem.

8. The apparatus of claim 1 wherein the expandable sleeve comprises one or more longitudinal slits extending along at least a portion of a length thereof to permit the expandable sleeve to move radially, and wherein application of an inwardly directed radial force causes the expandable sleeve to contract radially around the support rod.

9. The apparatus of claim 8 further comprising one or more O-rings circumscribing the expandable sleeve for providing the inwardly directed radial force.

10. The apparatus of claim 1 wherein the expandable sleeve comprises three longitudinal slits extending along an entire length thereof and equally spaced around the sleeve circumference.

11. The apparatus of claim 1 wherein the biasing means comprises a spring for urging the expandable sleeve toward the engaging position.

12. The apparatus of claim 11 further comprising a collar slidably mounted on the support rod, a portion of the collar being disposed about a portion of the expandable sleeve.

13. The apparatus of claim 12 wherein an end of the spring abuts the collar.

14. An apparatus for retrieving an object from within a well, wherein the object has an object opening for receiving the apparatus, the apparatus comprising:

a support rod having a first end and a second end; and an expandable sleeve slidably disposed about the support rod, wherein the expandable sleeve comprises a plurality of longitudinal slits extending along an entire length thereof to define a plurality of completely separable expandable sleeve segments, and one or more resilient rings circumscribing the expandable sleeve to cause the expandable sleeve to contract radially around the support rod, the expandable sleeve being movable from an insertion position wherein the expandable sleeve may be inserted into the object opening to an engaging position wherein the expandable sleeve grippingly engages the object opening.

15. The apparatus of claim 14 wherein the support rod comprises:

a tapered insertion tip; and a stem extending from the tapered insertion tip, the stem having a tapered portion and a generally cylindrical portion wherein in the expanded position the expandable sleeve is disposed about the tapered portion.

16. The apparatus of claim 14, wherein at least a portion of the expandable sleeve sections have a plurality of ridges thereon for grippingly engaging the object opening.

17. The apparatus of claim 16, wherein each of the expandable sleeve sections has a plurality of ridges thereon.

18. The apparatus of claim 17, wherein the ridges are defined by an externally threaded portion of the expandable sleeve section.

19. The apparatus of claim 14, wherein the object displaces the expandable sleeve to the insertion position as the insertion tip is inserted into the object opening.

20. The apparatus of claim 14, wherein the object opening has an internal thread, and wherein the expandable sleeve is externally threaded.

21. The apparatus of claim 20, wherein the object comprises a check valve in a water well.

22. Apparatus for retrieving an object from a well, the object having an object opening for receiving the apparatus, the apparatus comprising:

a support rod having first and second ends;

an expandable sleeve disposed about the support rod for grippingly engaging the object, the expandable sleeve comprising a plurality of discrete expandable sleeve sections;

at least one resilient ring disposed about the expandable sleeve for applying a radially inwardly directed force to the expandable sleeve, the expandable sleeve having a plurality of circumferential ridges thereon, the expandable sleeve being movable between an insertion position wherein the sleeve may be inserted in the object opening, and an expanded, engaging position wherein the ridges grippingly engage threads defined in the object opening.

23. A method for retrieving an object from a well bore with a fishing tool, wherein the object has an object opening for receiving the fishing tool, and wherein the fishing tool comprises a support rod having an insertion tip, and an expandable sleeve slidably disposed about the support rod having a plurality of external ridges thereon for grippingly engaging the object, the method comprising the steps of:

lowering the fishing tool into the well bore to the object;

inserting the insertion tip into the object opening;

displacing the expandable sleeve to an insertion position on the support rod;

inserting at least a portion of the expandable sleeve into the object opening;

moving the expandable sleeve to the engaging position on the support rod to grippingly engage the object; and raising the tool and object from the well bore;

wherein said well bore is a water well bore and said object is a check valve.

24. The method of claim 23, the fishing tool further comprising a spring disposed about the support rod, the moving step comprising:

lifting the support rod in the well after inserting the expandable sleeve into the object opening; and urging the expandable sleeve to the engaging position with the spring.

25. An apparatus for retrieving an object from within a well, wherein the object has an object opening for receiving the apparatus, the apparatus comprising:

a support rod having a first end and a second end; and an expandable sleeve having a plurality of external ridges thereon slidably disposed about the support rod, the expandable sleeve being movable from an insertion position wherein the expandable sleeve may be inserted into the object opening to an engaging position wherein the external ridges grippingly engage the object wherein the second end of the support rod is adapted to be connected to a cable for lowering and raising the apparatus within the well.

26. An apparatus for retrieving an object from within a well, wherein the object has an object opening for receiving the apparatus, the apparatus comprising:

a support rod having a first end and a second end; and an expandable sleeve having a plurality of external ridges thereon slidably disposed about the support rod, the expandable sleeve being movable from an insertion position wherein the expandable sleeve may be inserted into the object opening to an engaging position wherein the external ridges grippingly engage the object wherein the second end of the support rod is adapted to be connected to a bumper jar for impacting the apparatus in a downward direction to facilitate insertion of the expandable sleeve into the object opening.

27. An apparatus for retrieving an object from within a well, wherein the object has an object opening for receiving the apparatus, the apparatus comprising:

a support rod having a first end and a second end; and an expandable sleeve having a plurality of external ridges thereon slidably disposed about the support rod, the expandable sleeve being movable from an insertion position wherein the expandable sleeve may be inserted into the object opening to an engaging position wherein the external ridges grippingly engage the object wherein the well is a water well and the object is a check valve.

* * * * *